US007665581B2

(12) United States Patent
Richter et al.

(10) Patent No.: US 7,665,581 B2
(45) **Date of Patent: *Feb. 23, 2010**

(54) METHOD AND DEVICE FOR AUTOMATIC CHECKING OF THE AVAILABILITY OF TECHNICAL EQUIPMENT IN OR AT A BUILDING

(75) Inventors: Lutz Richter, Berlin (DE); Kilian Schuster, Ballwil (CH); Paul Friedli, Remetschwil (CH)

(73) Assignee: Inventio AG, Hergiswil NW (CH)

( * ) Notice: Subject to any disclaimer, the term of this patent is extended or adjusted under 35 U.S.C. 154(b) by 624 days.

This patent is subject to a terminal disclaimer.

(21) Appl. No.: 10/598,587

(22) PCT Filed: Mar. 4, 2005

(86) PCT No.: PCT/CH2005/000132

§ 371 (c)(1),
(2), (4) Date: Sep. 5, 2006

(87) PCT Pub. No.: WO2005/085112

PCT Pub. Date: Sep. 15, 2005

(65) Prior Publication Data

US 2007/0174065 A1 Jul. 26, 2007

(30) Foreign Application Priority Data

Mar. 5, 2004 (EP) ..... 04405130

(51) Int. Cl.
*B66B 1/34* (2006.01)

(52) U.S. Cl. ..... 187/391; 187/380; 187/386

(58) Field of Classification Search ..... 187/380–388, 187/391–394
See application file for complete search history.

(56) References Cited

U.S. PATENT DOCUMENTS 3,973,648 A 8/1976 Hummert et al.

(Continued)

FOREIGN PATENT DOCUMENTS

EP 0364151 A2 4/1990

(Continued)

*Primary Examiner*—Walter Benson
*Assistant Examiner*—Eduardo Colon-Santana
(74) *Attorney, Agent, or Firm*—Fraser Clemens Martin & Miller LLC; William J. Clemens

(57) ABSTRACT

The method serves for automatic checking of the availability of technical equipment which is arranged in or at a building and executes at least one repeatable procedure, and comprises the following steps. There is determined at least one estimated value ($N_S(i,t)$) for the frequency of the performance of the procedure for a first time period and/or second estimated value ($N_S(i,t+\Delta t)$) for the frequency of the performance of the procedure for a second time period. A measured value $N_m(i,t)$) for the frequency of the performance of the procedure for the first time period is determined and the measured value is compared with at least one of the estimated values ($N_S(i,t)$, $N_S(i,t+\Delta t)$). If the measured value ($N_m(i,t)$) is smaller by a predetermined amount ($N_S(i,t)-N_{min}(i,t)$, $\Delta N_s$) than the respective estimated value ($N_S(i,t)$, $N_S(i,t+\Delta t)$) at least one test of the technical equipment is carried out, in which test at least one reaction of the technical equipment is registered and compared with a target reaction, wherein in the case of availability of the technical equipment the reaction corresponds with the target reaction.

11 Claims, 5 Drawing Sheets

U.S. PATENT DOCUMENTS

| | | | | | |
|---|---|---|---|---|---|
| 4,397,377 | A | * | 8/1983 | Husson et al. | 187/382 |
| 4,568,909 | A | | 2/1986 | Whynacht et al. | |
| 5,064,026 | A | * | 11/1991 | Nagata et al. | 187/391 |
| 5,398,782 | A | * | 3/1995 | Talbot et al. | 187/393 |
| 5,487,448 | A | * | 1/1996 | Schollkopf et al. | 187/247 |
| 5,892,190 | A | * | 4/1999 | Morita et al. | 187/382 |
| 6,328,134 | B1 | * | 12/2001 | Hikita | 187/382 |
| 7,370,732 | B2 | * | 5/2008 | Richter et al. | 187/391 |
| 7,398,860 | B2 | * | 7/2008 | Amano | 187/247 |
| 7,475,122 | B2 | * | 1/2009 | Azpitarte | 709/217 |

FOREIGN PATENT DOCUMENTS

| | | | |
|---|---|---|---|
| EP | 0364151 | A3 | 4/1990 |
| EP | 1378477 | A1 | 5/1990 |
| WO | WO 03/066497 | A | 8/2003 |

* cited by examiner

METHOD AND DEVICE FOR AUTOMATIC CHECKING OF THE AVAILABILITY OF TECHNICAL EQUIPMENT IN OR AT A BUILDING

BACKGROUND OF THE INVENTION

The present invention relates to a method for automatic checking of the availability of technical equipment in or at a building, and to a device for automatic checking of the availability of technical equipment.

There are usually installed in buildings or in the environment of buildings a number of items of technical equipment which in normal operation multiply execute at least one repeatable procedure in order to satisfy various needs of users of the respective building, for example elevators, alarm and warning systems for protecting against risks due to break-ins, fire, smoke or water, heating, ventilation and air-conditioning installations, office equipment, communications systems, etc. In the case of an elevator installation, for example, the travel of a car is a repeatable procedure in this sense. Correspondingly, repeatable procedures can be defined in the case of other technical equipment.

It is in the interests of a user of a building that all items of technical equipment in the building are in a state of guaranteeing to the user a greatest possible degree of availability. Since operational disturbances can impair the availability of the technical equipment and in a given case can cause a reduction in convenience or even represent a safety risk it is of interest for operational disturbances of the respective technical equipment to be recognized as early as possible and the causes thereof established.

In order to avoid interruptions in operation as much as possible, items of technical equipment are in a given case subjected to maintenance with greater or lesser frequency. A component of maintenance is often performance of diagnosis by means of which it is established whether the technical equipment fulfils all intended functions in accordance with the expectation. A test of the technical equipment is frequently carried out within the scope of such a diagnosis. Thus, a control of the technical equipment can be given a suitable command and subsequently a reaction of the technical equipment registered and compared with a target reaction. The target reaction is in that case that reaction caused by the respective command insofar as the technical equipment behaves as intended in accordance with its specification. If the diagnosis reveals a difference between the target reaction and the reaction actually registered consequent to the command, then this indicates an operating fault.

According to European patent document EP 1378477 A1 technical equipment in buildings can be controlled by a monitoring system in that specific state data of the controls of the items of technical equipment to be monitored are communicated by way of a communications network to a monitoring station. The state data received in the monitoring station do not allow any reliable conclusions about whether or not the respective item of technical equipment is available at that moment. If, for example, the technical equipment in normal operation is in use only with interruptions or if the control of the technical equipment itself should have a defect an impairment of the availability of the technical equipment is not recognized without further measures or is recognized only with a delay.

SUMMARY OF THE INVENTION

The present invention addresses the stated disadvantages. The invention has the object of creating a method for automatic checking of the availability of technical equipment, which is suitable for detecting as rapidly and as reliably as possible an impairment of the availability of the technical equipment during a desired time period, particularly during normal operation. Moreover, the present invention shall provide a device suitable for carrying out such a method.

In the case of the method according to the present invention an automatic checking of the availability of technical equipment is realized in that at least one test of the technical equipment is carried out under specific conditions, in which test at least one reaction of the technical equipment is registered and compared with a target reaction. In one step of a method a measured value is determined for the frequency of the performance of the procedure for a first time period. The test is carried out only when the measured value is less by a predetermined amount than a predetermined value which is set to be either equal to a first estimated value for the frequency of performance of the procedure for the first time period or equal to a second estimated value for the frequency of the performance of the procedure for a second time period. If the registered reaction corresponds with the target reaction then it can be assumed that the technical equipment is available. If the registered reaction does not correspond with the target reaction then it can assumed that the technical equipment is unavailable.

The method has the advantage that tests of the respective technical equipment have to be carried out only when certain easily detectable measured values depart from specific target values.

By the expression "frequency of the performance of the procedure" there shall be understood in this connection every quantitative measure which characterizes how often the procedure can be registered within a specific period of time. Alternatively, it is also possible to derive the said frequency from a length of the time interval which extends from a predetermined point in time to a point in time at which performance of the procedure a further time is observed, wherein the said frequency could be determined as the reciprocal value of the time interval.

The present invention proceeds from the fact that the current execution of a procedure in technical equipment is usually evidence of it being available. A cause for checking the availability of the technical equipment by means of a test is seen during operation only exceptionally in two cases:

- if the frequency, which is measured in operation, of the procedure in a specific time period is less than expected (in this case an operational disturbance could be present) or
- if, starting from a specific first time period, a rise in the frequency of the procedure in a second (later) time period by a predetermined amount is expected (in this case prior to the expected rise in the frequency of the procedure it is checked whether the technical equipment is available so as in a given case—if the technical equipment should be unavailable—to be able to restore, by means of suitable measures the availability of the technical equipment in good time prior to the rise).

An estimated value for the frequency of the performance of the procedure executed by the technical equipment can be ascertained for a predetermined period of time in that, for example, initially prior to this time period the respective performances of the procedure and the point in time at which the respective performance of the procedure begins are registered. In a further step it can be determined, on the basis of plausible assumptions with respect to future development of the frequency of the performance of the procedure from the already registered points in time, which frequency of the performance of the procedure can be expected for the predetermined period of time. This expected frequency would in this connection be regarded as the estimated value stated in the foregoing.

The frequency of the performance of the procedure and the future development of this frequency can be described within the scope of a use model, i.e. on the basis of a theoretical model which describes the mode and manner of use of the technical equipment in normal operation and optionally detects the anticipated behavior of the users of the building and the influence of the users on the frequency of the performance of the procedure. It is possible within the scope of the invention to suitable select a use model depending on the respective situation.

One form of embodiment of the method according to the present invention comprises the method steps stated in the following: a first estimated value for the frequency of the performance of the procedure and a measured value for the frequency of the performance of the procedure are each determined for a first time period and a second estimated value for the frequency of the performance of the procedure for a second time period following the first time period is set to a value which (i) is equal to the first estimated value if the first estimated value and the measured value differ by more than a predetermined amount or (ii) is smaller than the first estimated value if the measured value is smaller than the first estimated value by more than the predetermined amount or (iii) is greater than the first estimated value if the measured value is greater than the first estimated value by more than the predetermined amount.

These method steps can be carried out iteratively. In a first repetition of the method steps initially a measured value for the use frequency for the second time period can be determined. Subsequently, an estimated value for a further time period following the second time period, etc., can be determined in accordance with one of the aforesaid method steps (i), (ii) or (iii).

This form of embodiment of the method according to the present invention has several advantages. The above steps (i), (ii) and (iii) can be realized, for example, in the form of a mathematical function which associates each time with an estimated value and a measured value for the frequency of the performance of the process for a predetermined time period an estimated value for a later time period. Such a mathematical function can be suitably selected for the purpose of the method according to the present invention in accordance with various criteria. On the one hand, the mathematical function defines a rule how an estimated value, which is required for carrying out the method, for the frequency of the performance of the procedure is to be calculated from measured values for the frequency of the performance of the procedure. The iteration of the aforesaid method steps accordingly enables execution of the method according to the invention in such a manner that each estimated value which has to be known at a specific point in time during performance of the method can be calculated with use of the mathematical function successively from measured values for the frequency of the performance of the procedure which were determined at an earlier point in time. Since the measured values for the frequency of the performance of the procedure can change in the course of time in operation of the technical equipment the estimated values, which are determined by means of the mathematical function, for the frequency of the performance of the procedure similarly change as a function of time. Accordingly, in the performance of the method the respective estimated values for the frequency of the performance of the procedure are continuously adapted in dependence on measured values for the frequency of the performance of the procedure. This adaptation contributes to the number of tests during performance of the method being kept as small as possible.

According to the present invention for carrying out the described method for automatic checking of the availability of technical equipment in or at a building a device is suitable which comprises:

a command transmitter by which a predetermined command for execution of at least one test of the technical equipment can be given to a control of the technical equipment, wherein the test is so selected that in the case of availability of the technical equipment a target reaction of the technical equipment can be registered, a registration device for registering a reaction of the technical equipment following the command and a device for comparing the reaction with the target reaction, equipment for determining and/or storing a first estimated value for the frequency of the performance of the procedure for a first time period and/or for determining and/or storing a second estimated value for the frequency of the performance of the procedure for a second time period, a measuring device for determining a measured value for the frequency of the performance of the procedure for the first time period and a control device for controlling the command transmitter in such a manner that the command is given when the measured value is smaller than one of the estimated values by a predetermined amount.

The device according to the present invention can be installed in the vicinity of the technical equipment in or at the building and can be equipped for communication, by way of a communications connection, of predetermined information to a monitoring station (for example to a remote monitoring station). If needed, for example if the reaction does not correspond with the target reaction, the device according to the invention can automatically produce the communications connection with the monitoring station, for example by way of a line-connected or wireless telephone network or data network. Should the situation arise that the technical equipment is unavailable then it is possible in this manner to automatically look after assistance. In this way technical equipment can be permanently monitored by a monitoring station without a permanent communications connection between the technical equipment and the monitoring station having to be produced.

The method according to the present invention and the device according to the present invention offer further advantages:

The point in time for a test is derived from observations during the operation of the technical equipment. Signs of operational disturbances are accordingly rapidly recognized. In this manner it is possible to keep the number of tests low.

The stated estimated values can be determined from measured values. The estimated values can accordingly be constantly adapted during operation of the technical equipment in order to take into account changed conditions. The method can be carried out so that the estimated values are continuously adapted in operation. This adaptation similarly contributes to the number of tests being kept low.

The device according to the invention can usually be retrofitted without difficulties in or at a building. The latter is favored by the circumstance that controls of technical equipment usually have suitable interfaces by way of which suitable commands for execution of a test of the technical equipment can be communicated to the control and that the procedures executed by the technical equipment and reactions of the technical equipment can usually be registered by simple measuring means, for example by way of registration of a change of a state of a drive and/or of a current supply and/or of a sensor and/or of a light source and/or of a status indication of the technical equipment or a registration of signals for control of the technical equipment.

In the following, an elevator installation with at least one elevator as a representative example for technical equipment in or at a building is considered in order to clarify the above concept. Use of the elevator is considered to be "repeatable procedure" in the sense of the invention. By "use" there shall be understood in this connection every service of the elevator benefiting a user, such as a car call, a floor call, a travel command and/or a command for opening or closing a door. In this case a "use frequency", i.e. the number of uses of the elevator per unit of time, can be regarded as a measure for the "frequency of the performance of the procedure" in the sense of the invention.

A use model could be obtained for an elevator in a publicly accessible building on the basis of, for example, a statistical analysis of uses. A statistical analysis can show, for example, that the frequency of use in accordance with expectation follows specific trends in dependence on a number of measurable magnitudes, for example as a function of time in the course of a day, from day to day or from week to week, due to the habits of the users or other influencing factors (opening times, holidays, weather, etc.). A statistical analysis of that kind usually leads to plausible assumptions with respect to the development over time of the use frequency if the uses during a series of time intervals are subject to boundary conditions which are more or less the same for every time interval. Under this precondition the course over time of the use frequency may be substantially the same for every time interval, so that characteristic time fluctuations of the use frequency repeat in substantially the same manner in a time interval following the time interval. In certain circumstances it can be anticipated that the course of the use frequency in a time interval is correlated with the course over time of the use frequency in one or more of the preceding time intervals. The latter can have the consequence that the course of the use frequency exhibits recognizable trends over a plurality of time intervals. In addition, events that are planned can influence the course of the use frequency. Thus, events in which a specific number of persons participate can influence the use frequency in a characteristic manner during a defined time period. For example, it can be expected that the use frequency at the beginning or end of such events strongly rises and subsequently subsides again, wherein the degree of rise depends on the number of participating persons.

A command for execution of at least one test of the elevator installation can comprise, for example, a car call, a floor call and/or a travel command. Car calls, floor calls and/or travel commands can be produced in conventional elevators by relatively simple means. This is frequently possible without use of detailed data about the construction of an elevator installation. The target reaction can comprise, for example, the following procedures: opening and closing of a floor door of the elevator installation and/or opening and closing of a car door and/or travel of a car from a predetermined floor to another predetermined floor. Procedures of that kind are relatively simple to detect by means of sensors which are present in any case in conventional elevator installations.

The present invention is particularly usable for checking the availability of items of technical equipment such as heating installations, air-conditioning installations, ventilating installations, cooling, freezing and other domestic appliances, lighting systems, communications systems, information systems, warning and alarm systems, apparatus for data or information processing, systems for data detection, systems for access control in buildings, and similar, insofar as these items of equipment execute at least one repeatable procedure.

In the case of a heating installation specific quantities of thermal energy are delivered by means of a heating element (for example, a burner) with interruptions in the course of time. In this example, activation of the heating element (for example a combustion process of a burner) or drive control of a pump for hot water or drive control of a valve for regulation of a hot water flow can, for example, be regarded as a repeatable procedure. For monitoring of the heating installation the frequency of activation of the heating element or the frequency of drive control of the pump or the valve can be measured and compared with corresponding estimated values. As a test of the heating installation it is possible, for example, with the heating element switched off for the target temperature to be reached by the heating installation to be temporarily increased (if, for example, the last activation of the heating element covered an unexpectedly long period of time). As target reaction the heating installation would have to start a new heating cycle of the heating element (if the heating installation is available) or suitably control the pump or the valve and drive so as to increase the hot water flow.

In the case of air-conditioning installations, ventilating installations and cooling and freezing appliances, for example, compressors are discontinuously operated by means of a drive motor or a throughflow is controlled by a regulating valve or a setting element is brought into different settings according to need. An activation of the drive motor or an actuation of the valve or the generation of a control signal for controlling the drive motor or the valve or the setting element can be regarded as a repeatable procedure in the sense of the invention. As a test of the said equipment, for example, a target value (temperature, air humidity), which is to be realized by the respective equipment, could be changed and it could be checked whether the said procedure is repeated subsequently to the change or whether a control of the equipment reacts in accordance with expectation.

In the case of communications systems (for example telephones, networks or data transmission) specific services (production of communications connection, transmission of specific items of information or data) are usually demanded by individual users from time to time. In this example the execution of a service can be regarded as a repeatable procedure in the sense of the invention. As a test of the respective communication system, for example, a simulation of a demand for a specific service can be undertaken, for example by mean of suitable control signals, which can be sent to a control unit of the communications system.

Further applications of the invention can be realized in the realm of information systems which reproduce items of information on request by users. The provision of specific items of information by the information system can, for example, be regarded as a repeatable procedure in the sense of the invention, for example the reproduction of items of information on a display apparatus or the offering of multimedia data by means of corresponding reproduction apparatus. As a test of the respective information system there can be undertaken, for example, a simulation of a request for a specific item of information, for example by means of suitable control signals which can be sent to a control unit of the information system.

Warning and alarm systems usually have the task of producing under specific conditions (for example in the case of fire, smoke, break-ins or water penetrations) a report (for example by transmitting a specific item of information to a specific address or to a specific addressee) or generating an alarm. Here the generation of a report or the triggering of an alarm can be regarded as a repeatable procedure in the sense of the invention or the detection, by measuring, of the magnitudes monitored by the warning or alarm system (for example recognition of a fire by means of a temperature or heat radiation measurement, measuring of state changes by movement reporting devices for recognition of break-ins, measurement of a liquid level in rooms or a smoke recognition) can be regarded as a repeatable procedure in the sense of the invention. As a test of the respective warning or alarm system there can be undertaken, for example, simulation of conditions which oblige the warning or alarm system to generate a predetermined report or to generate a predetermined alarm, for example by means of suitable control signals which can be sent to a control unit of the warning or alarm system.

In the case of a lighting system with one or more light sources (for example at traffic routes, in or at buildings or in stairwells) the switching-on and/or switching-off of the light sources is or are usually correlated with the presence of persons and with respective times of day. In this case, for example, the switching-on of a light source can be considered to be a repeatable procedure in the sense of the invention. As a test of the lighting system, for example, the light sources of the system can be switched on a trial basis (by drive control of corresponding switches) or the light intensity of light sources can be varied (for example by drive control of a control unit of the lighting system). The switching-on and/or switching-off of the light sources can be controlled by light, voltage or current sensors.

Apparatus for data or information processing, for example printers, photocopiers or scanners, usually execute individual orders, the processing of which can be initiated manually or by a control, for example printing, copying or scanning orders. The processing of an order can be regarded as a repeatable procedure in the sense of the invention. As a test of the respective apparatus a command for processing of a predetermined order can be given to a control of the apparatus by an automatic drive control. It can be subsequently checked whether the apparatus executes the order according to expectation.

Systems for data detection (for example systems for detection of working time or presence of persons) or systems for access control in buildings have to detect specific items of information from time to time (for example reading in personal data from data carriers, detection of biometric data, detection of image information) and in a given case evaluate these. The detection and processing of an item of information can in this case be regarded as a repeatable procedure in the sense of the invention. As a test of the respective system that interface of the system which is provided for detection of information can be offered test information in a suitable format for further processing. It can then be checked whether the system processes the test information according to expectation.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
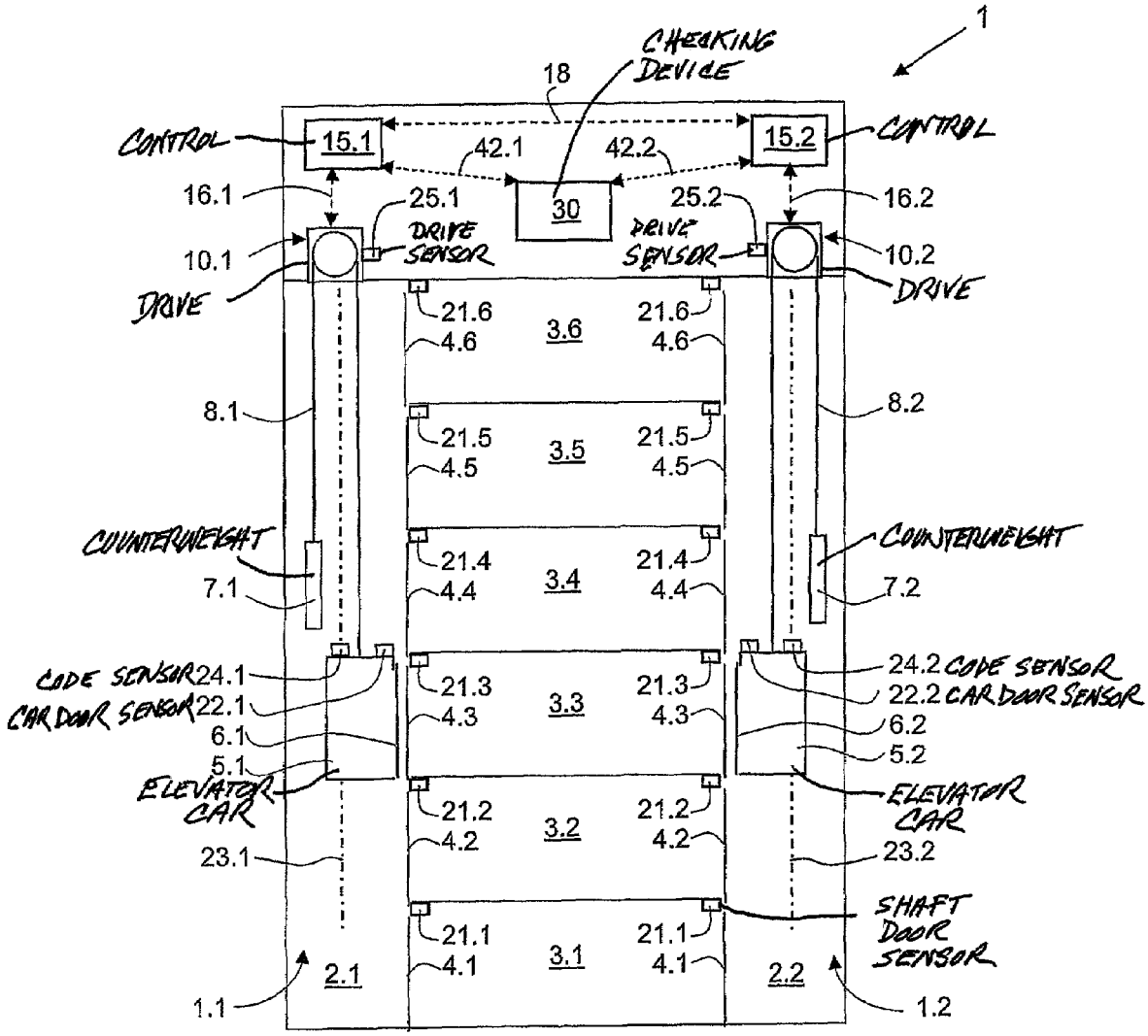
FIG. 1 is a schematic illustration of an elevator installation with two elevators and a device according to the present invention for automatic checking of the availability of the elevator installation.

FIG. 1 shows an elevator installation 1 with two elevators 1.1 and 1.2 of the same form of construction in conjunction with a device 30 according to the present invention for automatic checking of the availability of the elevator installation 1. This is installed in a building with six floors 3.1, 3.2, 3.3, 3.4, 3.5 and 3.6. A respective shaft 2.1 or 2.2 is provided for each of the elevators 1.1 and 1.2. Two shaft doors 4.*x* (x=1-6) are disposed each time on each floor 3.*x*.

The elevator 1.1 comprises: a car 5.1 with a car door 6.1 at a side facing the floors 3.*x*, a counterweight 7.1, a support means 8.1 for the car 5.1 and the counterweight 7.1, a drive 10.1 with a drive pulley for the support means 8.1 and an elevator control 15.1. The car 5.1 and the counterweight 7.1 are respectively connected together by way of the support means 8.1, wherein the support means 8.1 loops around the drive pulley of the drive 10.1. Activation of the drive 10.1 causes rotation of the drive pulley and thus movement of the car 5.1 and the counterweight 7.1 in opposite sense upwards or downwards. Signals can be transferred between the elevator control 15.1 and various controllable components of the elevator 1.1 by way of a communications connection 16.1 for control of the elevator 1.1 in operation.

Correspondingly, the elevator 1.2 comprises a car 5.2 with a car door 6.2 on a side facing the floors 3.*x*, a counterweight 7.2, a support means 8.2 for the car 5.2 and the counterweight 7.2, a drive 10.2 with a drive pulley for the support means 8.2 and an elevator control 15.2. The car 5.2 and the counterweight 7.2 are respectively connected together by way of the support means 8.2, wherein the support means 8.2 loops around the drive pulley of the drive 10.2. Activation of the drive 10.2 causes rotation of the drive pulley and thus movement of the car 5.2 and the counterweight 7.2 in opposite sense upwards and downwards. Signals are transferred between the elevator control 15.2 and different controllable components of the elevator 1.2 by way of a communications connection 16.2 for control of the elevator 1.2 in operation.

The elevators 1.1 and 1.2 can be controlled independently of one another by the elevator controls 15.1 and 15.2, respectively. In addition, a communications connection 18 between the elevator controls 15.1 and 15.2 is provided. Signals can be exchanged between the elevator controls 15.1 and 15.2 in case of need by way of the communications connection 18 in order to be able to operate the elevators 1.1 and 1.2 as an elevator group with a group control.

Figure 2:
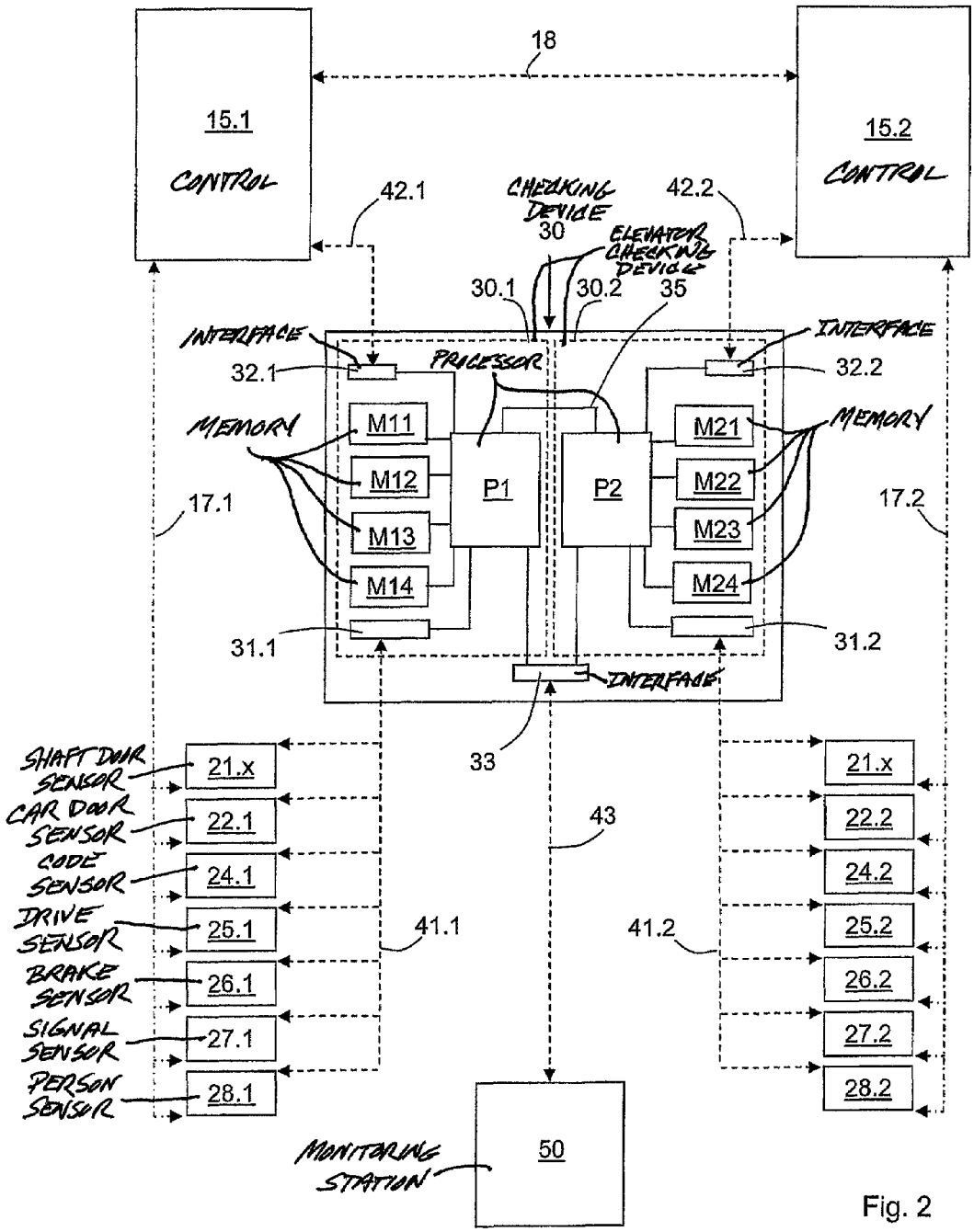
FIG. 2 is a block diagram of the automatic checking device of FIG. 1.

The elevator installation 1 has—as is indicated in FIGS. 1 and 2—a number of devices intended for the purpose of detecting various operational states of the elevator installation and in a given case registering changes of operational states:

- items of equipment 21.1, 21.2, 21.3, 21.4, 21.5, 21.6 for monitoring and registering actuation of the shaft doors 4.1, 4.2, 4.3, 4.4, 4.5, 4.6;
- items of equipment 22.1 or 22.2 for monitoring the car doors 6.1 and 6.2 and registering actuation of the car doors 6.1 and 6.2;
- a coding 23.1, which is arranged in the shaft 2.1, for indicating a position of the car 5.1 and an item of equipment 24.1, which is arranged at the car 5.1, for reading the coding 23.1 and for detection of the position of the car 5.1;
- a coding 23.2, which is arranged in the shaft 2.2, for indicating a position of the car 5.2 and an item of equipment 24.2, which is arranged at the car 5.2, for reading the coding 23.2 and for detection of the position of the car 5.2;
- items of equipment 25.1 and 25.2 for registering a state of the drive 10.1 and 10.2, respectively, and for registering a change of the state of the drive 10.1 and 10.2, respectively (a state of a drive can be characterized by, for example, a current flow in the respective drive or a speed or an acceleration of components which are moved in the case of activation of the respective drive);
- items of equipment 26.1 and 26.2 for registration of an actuation of a brake of the elevator 1.1 and 1.2, respectively;
- items of equipment 27.1 and 27.2 for registration of signals of the elevator control 15.1 and 15.2, respectively (for controlling the elevator installation); and
- items of equipment 28.1 and 28.2 for registration of persons in the environment of the elevator installation 1 or the elevators 1.1 and 1.2 (for example movement reporting devices, cameras, light barriers, etc.).

In the case of use of one of the elevators 1.1 and 1.2 usually at least one of the doors is moved and/or the position of one of the cars 5.1 and 5.2 changed and/or a state of one of the drives 10.1 and 10.2 changed and/or at least one signal of one of the elevator controls 15.1 and 15.2 produced. Moreover, use usually presupposes the presence of at least one person in the vicinity of the elevator installation 1.

In the case of use of one of the elevators 1.1 and 1.2 changes of operational states accordingly usually occur, which can be detected by one of the items of equipment 21.1, 21.2, 21.3, 21.4, 21.5, 21.6, 22.1, 22.2, 24.1, 24.2, 25.1, 25.2, 26.1, 26.2, 27.1, 27.2, 28.1, 28.2. These items of equipment provide signals which characterize the respective operational state. A use of one of the elevators 1.1 and 1.2 can accordingly be registered with the help of one of the aforesaid items of equipment. The signals of these items of equipment can be detected by the elevator controls 15.1 and 15.2 by way of communications connections 17.1 and 17.2, respectively, as is indicated in FIG. 2.

FIG. 2 shows details of the checking device 30. This comprises a device 30.1 for checking the availability of the elevator 1.1 and a device 30.2 for checking the availability of the elevator 1.2. The devices 30.1 and 30.2 are of substantially identical construction.

The device 30.1 comprises a processor P1 and different components, with which the processor P1 can exchange data in operation:

- a communications interface 31.1 for communication with the items of equipment 21.1, 21.2, 21.3, 21.4, 21.5, 21.6, 22.1, 24.1, 25.1, 26.1, 27.1, 28.1 by way of a communications connection 41.1;
- a communications interface 32.1 for communication with the elevator control 15.1;
- a memory M11 for a program for checking the availability of the elevator 1.1 (termed "P1.1" in the following);
- a memory M12 for estimated values for a use frequency of the elevator 1.1;
- a memory M13 for measured values for the use frequency of the elevator 1.1; and
- a memory M14 for data.

The program "P1.1" can run down under the control of the processor P1. The program "P1.1" controls different processes:

a) Under the control of the program "P1.1" the processor P1 can evaluate signals of the items of equipment 21.1, 21.2, 21.3, 21.4, 21.5, 21.6, 22.1, 24.1, 25.1, 26.1, 27.1, 28.1.

b) Evaluation of the signals according to a) enables registration of uses of the elevator 1.1 and the determination of measured values for the use frequency of the elevator 1.1. The processor P1 accordingly forms together with at least one of the items of equipment according to a) and the memory M11 a measuring device for the use frequency of the elevator 1.1. The measured values for the use frequency can be registered as a function of time. The measured values for the use frequency can be filed in the memory M13.

c) Under the control of the program "P1.1" the processor P1 can give commands which are communicated by way of the communications connection 42.1 to the elevator control 15.1, for example a command for execution of a test of the elevator 1.1. The processor P1 accordingly forms together with the memory M11 a command transmitter for the elevator control 15.1.

d) Under the control of the program "P1.1" the processor P1 can register and evaluate the signals of the items of equipment 21.1, 21.2, 21.3, 21.4, 21.5, 21.6, 22.1, 24.1, 25.1, 26.1, 27.1, 28.1 which directly follow the respective command according to c). The signals characterize a reaction of the elevator 1.1 to the respective command. The processor P1 accordingly forms together with at least one of the previously mentioned items of equipment and the memory M11 a registration device for reactions of the elevator 1.1.

e) In the memory M14 there can be stored, for example, data which specifies all possible target reactions of the elevator 1.1 and are respectively associated with the commands which can be given to the elevator control and cause the respective target reactions. Under control of the program "P1.1" the processor P1 can ascertain, for the command given to the elevator control according to d), the corresponding target reaction and compare a reaction registered according to d) with the target reaction. The processor P1 accordingly forms together with the memory M11 and the memory M14 an item of equipment for comparing a reaction with a target reaction.

f) Estimated values for the use frequency of the elevator 1.1 can be filed in the memory M12. Estimated values for the use frequency for a specific time period can be determined under the control of the program "P1.1", for example from measured values for the use frequency according to method, which are explained in the following. Signals of the items of equipment 28.1 and 28.2 can also be utilized for determination of estimated values for the use frequency. Signals of these items of equipment give information about the number of persons who approach the elevator installation or go away from the elevator installation or stand in a region at the elevator installation. If the number of persons registered by the items of equipment 28.1 and 28.2 changes then it is to be expected that in the course of time the use frequency of the elevator would also change. If the items of equipment 28.1 and 28.2 register a specific number of persons who approach the elevator installation 1 then it is to be expected that the use frequency will rise. If in this case, for example, a measured value for the use frequency for a first time period is known, then an estimated value of the use frequency for a later time period can be calculated from the measured value and the number of registered persons can be calculated. The number of registered persons in this case establishes an upper limit for the use frequency in the second time period.

g) Under the control of the program "P1.1" the processor P1 can compare estimated values and measured values for the use frequency and decide, in dependence on a result of the comparison, whether and in a given case when a command for execution of a test of the elevator 1.1 according to c) shall be given.

Analogously to the construction of the device 30.1, the device 30.2 comprises a processor P2 and different components which can exchange data with the processor P2 in operation:

- a communications interface 31.2 for communication with the items of equipment 21.1, 21.2, 21.3, 21.4, 21.5, 21.6, 22.2, 24.2, 25.2, 26.2, 27.2, 28.2 by way of a communications connection 42.2;
- a communications interface 32.2 for communication with the elevator control 15.2;
- a memory M21 for a program for checking the availability of the elevator 1.2 (termed program "P1.2" in the following);
- a memory M22 for estimated values for a use frequency of the elevator 1.2;
- a memory M23 for measured values for the use frequency of the elevator 1.2; and
- a memory M24 for data.

The program "P1.2" can run down under the control of the processor P2. The program "P1.1" and program "P1.2" are equivalent. The statements with respect to the program "P1.1" in accordance with the above points a)-g) correspondingly apply to the program "P1.2", wherein the functions of the communications interfaces 31.2 and 32.2 of the device 30.2 corresponds with the respective functions of the communications interfaces 31.1 and 32.1 of the device 30.1. The functions of the memories M21, M22, M23, M24 of the device 30.2 correspond with the respective function of the memories M11, M12, M13, M14.

The processors P1 and P2 can be connected together by way of a communications connection 35, as is indicated in FIG. 2. Data can be exchanged between the processors P1 and P2 by way of the communications connection 35. This is useful if the elevators 1.1 and 1.2 are operated as an elevator group with a group control. However, the devices 30.1 and 30.2 can also be operated independently of one another.

The program "P1.1" or "P1.2" can give several different commands for execution of a test to the elevator control 15.1 or 15.2: for example a car call, a floor call and/or a travel command. Correspondingly, different target reactions of the elevator 1.1 or 1.2 are taken into consideration: opening and closing of a shaft door of the elevator installation and/or opening and closing of a car door and/or travel of a car from one predetermined floor to another predetermined floor.

As is indicated in FIG. 2, the processors P1 and P2 are connected with the communications interface 33 for communication with a monitoring station 50 by way of a communications connection 43. If during operation of the devices 30.1 and 30.2 it should be established that one of the elevators 1.1 and 1.2 is not available, then the processors P1 and P2 can communicate by way of the communications connection 43 a predetermined item of information to the monitoring station 50 in order to indicate this situation.

Two variants of the method according to the present invention for automatic checking of the availability of an elevator installation are described in the following by way of the example of the elevator installation 1.

Method A

The method "A" is explained on the basis of an example for automatic checking of the availability of the elevator 1.1 with the help of the device 30.1.

With respect to the uses of the elevator 1.1 the starting point is a use model based on the following assumptions:

- The starting point is that the elevator 1.1 is used in a sequence of successive time periods $\Delta T(i)$ with respectively the same duration $t_e(i)-t_0(i)$. The index "i" ($i \geqq 1$) characterizes the respective time intervals, $t_0(i)$ denotes the time point of the start of the time period $\Delta T(i)$ and $t_e(i)$ denotes the time point of the end of the time period $\Delta T(i)$.
- It is assumed that all uses take place under conditions which repeat in similar manner after the beginning of each individual one of the time periods $\Delta T(i)$. Under this presumption it is anticipated that a use frequency of the elevator 1.1 in each of the time periods $\Delta T(i)$—apart from statistical fluctuations—exhibits the same time course (referred to the start of the respective time period). For the sake of simplicity it is assumed that the end of the time period coincides with the start of the directly following time period, i.e. $t_e(i)=t_0(i+1)$.

A use model of that kind is, for example, realistic for an elevator installation in a public building. The number of visitors of such a building and thus the number of users of the elevator installation fluctuates on succeeding days—due to opening times, habits of the visitors, or similar—respectively according to the same regularities as a function of time. In certain circumstances the number of users is additionally subject to fluctuations from day to day, which follow long-term trends, for example due to seasonal influences.

Under the stated preconditions it can be assumed that an estimated value for the use frequency for a specific time period $\Delta T(n)$ can be obtained from measured values for the use frequency for one or more earlier time periods $\Delta T(i)$, wherein $i<n$, by means of statistical methods.

According to method "A", measured values for the use frequency are determined as follows.

The starting point is a succession of uses of the elevator 1.1, which take place at the time points $t_B(k)$ after the beginning of the time period $\Delta T(i=1)$. The index k characterizes the individual uses.

For times $t>t_0(i)$ the uses of the elevator 1.1 and the respective time point $t_B(k)$ of a use are registered by means of the device 30.1.

For times $t>t_0(i)$, measured values $N_m(i,t)$ for a use frequency of the elevator 1.1 are determined as follows. Each time period $\Delta T(i)$, wherein $t_0(i)\leqq t\leqq t_0(i)$, is respectively subdivided into a predetermined number of, for example, "m" time intervals $\delta T(i,j)$ of equal length "d", wherein $\delta T(i,j)$ is defined as time period $$\delta T(i,j):t_0(i)+(j-1)d\leqq t\leqq t_0(i)+jd$$

wherein $d=(t_e(i)-t_0(i))/m$ and $j=1, \ldots, m$.

By N(i,j) there is denoted the number of uses which are registered in the time interval $\delta T(i,j)$. The measured value $N_m(i,t)$ for the use frequency is now defined according to $$N_m(i,t)=N(i,j)/d$$

for $t_0(i)+(j-1)d\leqq t\leqq t_0(i)+j\,d$

The measured value $N_m(i,t)$ of the use frequency is accordingly determined as the quotient of the number of the uses registered during the time interval $\delta T(i,j)$ and the duration of the time interval $\delta T(i,j)$.

In method "A" it is provided to determine an estimated value $N_S(i,t)$ for the use frequency of a specific time period $\Delta T(i)$ from measured values for the use frequency for the time period $\Delta T(i)$ of preceding time periods $\Delta T(k)$, wherein $k<i$.

Estimated values $N_S$ can, for example, be iteratively determined according to the recursion formula (proceeding from i=1):

$$N_S(i+1,t)=N_S(i,t-\Delta(i))+[N_m(i,t-\Delta(i))-N_S(i,t-\Delta(i))]/\lambda=F(i,t,\lambda)$$

wherein $\Delta(i)=t_0(i+1)-t_0(i)$ indicates the time span between the start of the time period $\Delta T(i+1)$ and the beginning of the time period $\Delta T(i)$. In the present case it is assumed that $t_0(i+1)=t_e(i)$, i.e. $\Delta(i)=t_e(i)-t_0(i)=t_e(i+1)-t_0(i+1)$ corresponds with the duration of the time periods $\Delta T(i)$ or $\Delta T(i+1)$.

The left-hand side of the recursion formula defines estimated values of the use frequency as a function of the time for the time period $\Delta T(i+1)$. The right-hand side considers estimated values and measured values for the use frequency as a function of the time for the time period $\Delta T(i)$. The term $\Delta(i)$ on the right-hand side of the recursion formula takes into consideration that the beginning of the time period $\Delta T(i+1)$ is disposed relative to the beginning of the time period $\Delta T(i)$ by the duration of the time period $\Delta T(i)$, i.e. by $\Delta(i)$, and that the method is based on the assumption that the use frequency in all time periods—referred to the beginning of the respective time period—should have a similar course as a function of time (apart from statistical fluctuations which can arise over several successive time periods).

The function $F(i,t,\lambda)$ contains a parameter $\lambda$, which can be selected to be suitable for optimization purposes and can be empirically determined. For $\lambda=1$ there applies, for example, $F(i,t,\lambda)=N_m(i,t-\Delta(i))$. In this case it is assumed that the use frequency measured for a time period $\Delta T(i)$ is the same as the estimated value for the use frequency for the following time period $\Delta T(i+1)$. In the boundary case $\lambda\rightarrow\infty$ there follows thereagainst $F(i,t,\lambda)=N_S(i,t-\Delta(i))=N_S(i+1,t-\Delta(i))$. In this case the estimated values for the use frequency were thus independent of the index i, i.e. identical for all time periods $\Delta T(i)$. In this case the measured values $N_m(i,t)$ for the use frequency have no influence on the size of the corresponding estimated values. The parameter $\lambda$ in the function $F(i,t,\lambda)$ accordingly determines by which weighting a measured value $N_m(i,t)$ for a time interval $\Delta T(i)$ influences, by comparison with estimated values of the use frequency for the time periods $\Delta T(k)$, wherein $k\leqq i$, the estimated value for the use frequency $N_S(i+1,t)$ for the following time period $\Delta T(i+1)$.

In other words: by means of an iteration according to the recursion formula $F(i,t,\lambda)$ the estimated values for the use frequency for successive time periods can be adapted to current trends which manifest themselves in the time dependence of the measured values for the use frequency in the course of several successive time periods $\Delta T(k)$, wherein $k\leqq i$.

The above iteration can be commenced with start values for $N_S(i=1,t)$ which can be selected as desired. In the case of repeated use of the iteration according to the function $N_S(i+1,t)=F(i,t,\lambda)$ the estimated values, which are calculated in that manner for the use frequency converge with greater or lesser rapidity towards realistic values which correspond with a statistic anticipated value for the use frequency according to a statistical analysis of uses of the elevator 1.1. The speed of the convergence depends on the selection of the parameter $\lambda$. The parameter $\lambda$ accordingly determines inter alia how quickly the device 30.1 in operation of the elevator 1.1 can, on the basis of the method "A", ascertain realistic statistical data for uses of the elevator 1.1. In the course of the convergence of the iteration the device 30.1 thus runs through a 'learning phase', during which it can collect and evaluate data about uses of the elevator 1.1.

The above parameter $\lambda$ can additionally be optimized according to the criterion that the device 30.1 in operation gives on the basis of the method "A" the fewest possible commands for execution of a test of the elevator 1.1. It will be obvious that instead of the iteration according to the function $N_S(i+1,t)=F(i,t,\lambda)$ also other statistical methods can be used in order to obtain realistic estimated values for the use frequency.

Figure 3A:
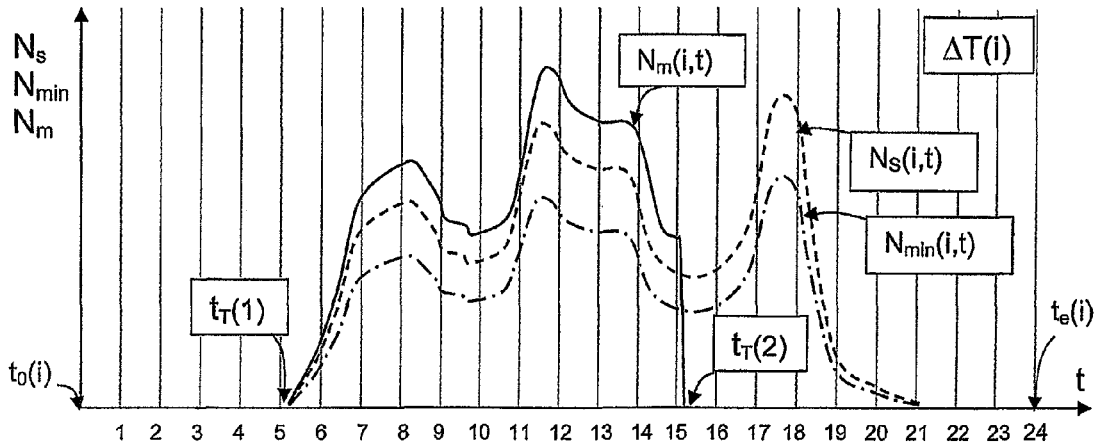
FIGS. 3*a* and 3*b* are plots of estimated values and measured values for a use frequency of an elevator as a function of time for different time periods.
Figure 3B:
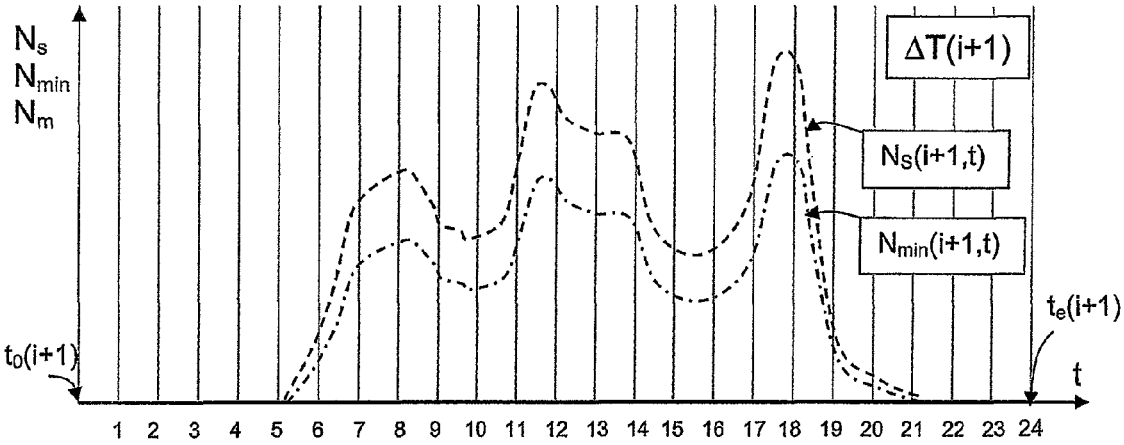

The method "A" is explained in the following by reference to FIGS. 3*a*, 3*b* and 4. FIGS. 3*a* and 3*b* show (arranged one above the other) two diagrams respectively as a function of time "t". The upper diagram FIG. 3*a* is associated with the time period $\Delta T(i)$ and the lower diagram FIG. 3*b* with the time period $\Delta T(i+1)$. The end of the time period $\Delta T(i)$ coincides with the beginning of the time period $\Delta T(i+1)$, i.e. $t_e(i)=t_0(i+1)$.

The diagrams illustrate data for estimated values $N_S$ and measured values $N_m$ and minimum values $N_{min}$, which are filed in the memories M12, M13 and M14. These data are selected, managed and analyzed during run-down of the program "P1.1".

The upper diagram in FIG. 3*a* shows an estimated value $N_S(i,t)$ for the use frequency of the elevator 1.1, a corresponding measured value $N_m(i,t)$ for the use frequency and a minimum value $N_{min}(i,t)$ for the use frequency. The lower diagram in FIG. 3*b* shows an estimated value $N_S(i+1,t)$ for the use frequency of the elevator 1.1 and a minimum value $N_{min}(i+1,t)$ for the use frequency.

The time axes of the diagrams have a division in each instance into twenty-four hours. The diagrams indicate by way of example that the elevator 1.1 is usually used only between five hours and twenty-one hours. The estimated values $N_S(i,t)$ and $N_S(i+1,t)$ are equal to "0" in the time period between twenty-one hours in the evening and five hours in the morning. According to the course of the curves $N_S(i,t)$ and $N_S(i+1,t)$ temporary peak values of the use frequency are expected between five and twenty-one hours each time in the morning, at midday and in the evening.

The diagrams in FIGS. 3*a* and 3*b* illustrate the estimated values $N_S$, measured values $N_m$ and minimum values $N_{min}$ for a time point around sixteen hours during the time period $\Delta T(i)$. According to FIG. 3*a* it is assumed that the measured values $N_m$ take up the value "0" closely above fifteen hours. In the time period between fifteen and sixteen hours, accordingly measured values for $N_m$ are detected, but no uses of the elevator 1.1 were registered. For the time from sixteen hours in the time period ΔTi still no measured values $N_m$ have been detected.

Figure 4:
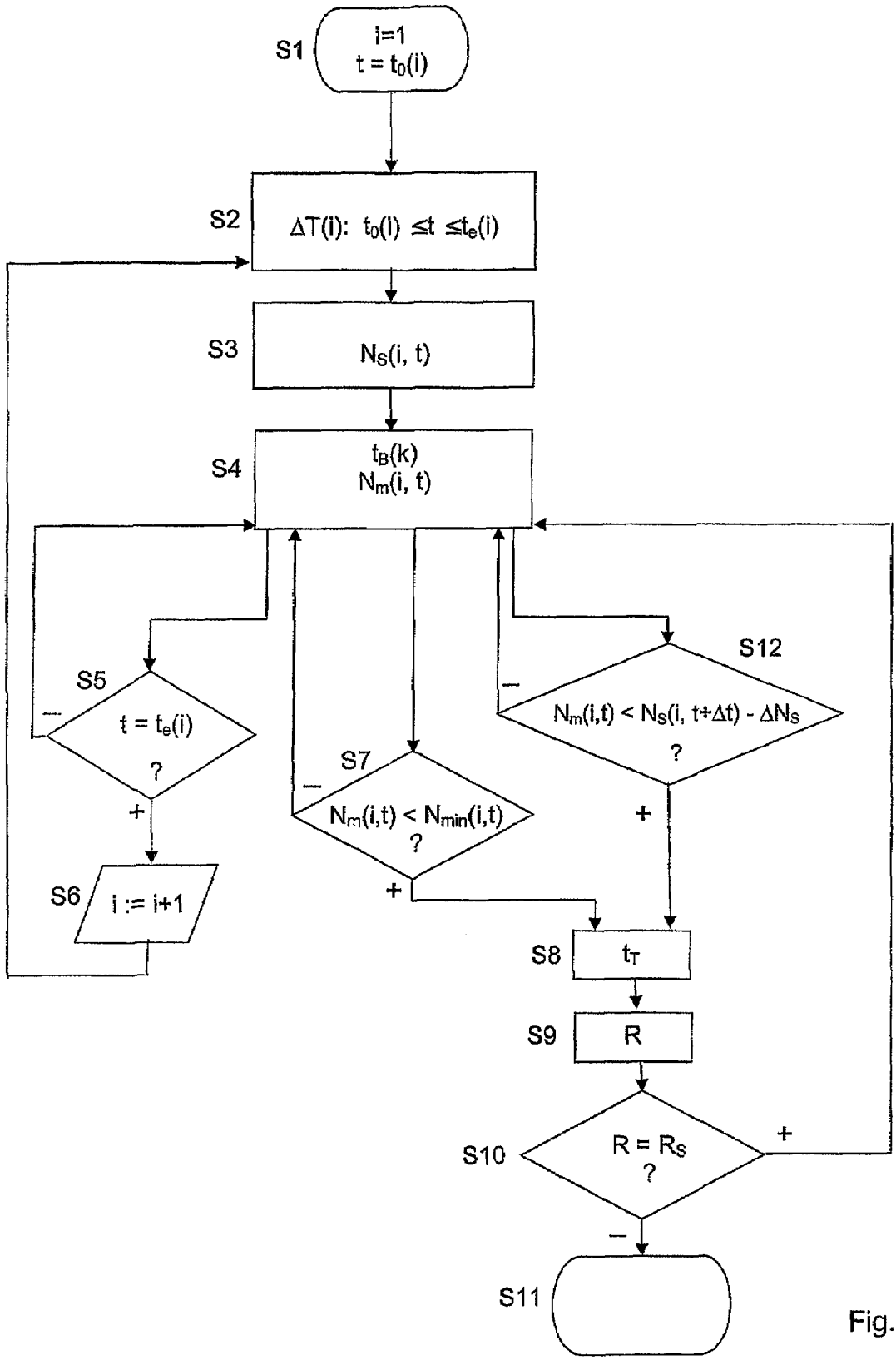
FIG. 4 is a flow chart for an embodiment of the method according to the present invention, which is usable on the estimated values or measured values according to FIGS. 3*a* and 3*b*.

FIG. 4 illustrates the steps of the method "A" in the form of a flow chart with the method steps S1-S12.

In method step S1 the device 30.1 is initialized: the processor P1 sets an internal counter "I" to i=1 and an internal clock to the time $t=t_0(i)$ i.e. the beginning of the time period ΔT(i). The run-down of the program "P1.1" is started. Subsequently there is continuation with step S2.

In method step S2 the time period ΔT(i) is established at $t_0(i) \leqq t \leqq t_e(i)$, in which the availability of the elevator 1.1 is to be checked. Subsequently there is continuation with step S3.

In method step S3 the estimated values $N_S(i,t)$ for the use frequency of the elevator 1.1 for the time period ΔT(i) are loaded from the memory M12 into the processor P1.

In method step S4 uses of the elevator 1.1 or the respective time point $t_B(k)$ of each use (index k) are registered and measured values $N_m(i,t)$ for the use frequency as a function of time during the time period ΔT(i) are determined and filed in the memory M13. Estimated values $N_S(i+1,t)$ can be calculated from the measurements values $N_m(i,t)$ and estimated values $N_S(k,t)$, wherein $k \leqq i$, for example according to the above iteration $N_S(i+1,t)=F(i,t,\lambda)$ and subsequently filed in the memory M12.

The method steps S5, S7 and S12 run parallel to the method step S4.

In method step S5 the processor P1 checks whether the end of the time period ΔT(i) is reached with $t_0(i) \leqq t \leqq t_e(i)$. If yes, then there is continuation with method step S6 (path +). If no, then there is continuation with method step S4 (path −).

In method step S6 the index "i" is increased by "1". Subsequently the preceding steps from S2 are repeated.

In method step S7 it is checked whether the measured value $N_m(i,t)$ for the use frequency of the elevator has fallen below the minimum value $N_{min}(i,t)$. $N_{min}(i,t)$ is smaller than the respective estimated value $N_S(i+1,t)$ by a predetermined amount, as is indicated in FIG. 3. If the measured value $N_m(i,t)$ for the use frequency of the elevator falls below the minimum value $N_{min}(i,t)$ then there is continuation with method step S8 (path +). If not, then continuation is with method step S4 (path −).

In method step S8 a command for execution of a test of the elevator 1.1 is given to the elevator control 15.1 (at the time point $t_T$). Subsequently there is continuation with method step S9.

In method step S9 a reaction "R" of the elevator 1.1 is registered.

Subsequently, in method step S10 the reaction "R" is compared with a target reaction "$R_S$". If the reaction "R" agrees with the target reaction "$R_S$", then it can be assumed that the elevator 1.1 is available. In this case there is continuation with S4 (path +). If the reaction "R" does not agree with the target reaction "$R_S$", then it can be assumed that the elevator 1.1 is not available. In this case there can be continuation of S11 (path −).

In method step S11 it is communicated to the monitoring station 50 that the elevator 1.1 is unavailable. The method is subsequently interrupted. When the elevator 1.1 is available again, then the method can be continued with the method step S1.

In method step S12 it is checked whether it is to be expected that—proceeding from a time point "t"—a rise of the use frequency by more than a predetermined amount $\Delta N_S$ is anticipated within a time period Δt, i.e. $(N_m(t)<N_S(t+\Delta t)-\Delta N_S)$. If a rise by more than $\Delta N_S$ is anticipated, then as a precaution a command for execution of a test according to method step S8 is given (path +). If the latter is not the case, then continuation is with S4 (path −).

As indicated in FIG. 3, in the case of the method steps S7 and S12 each time a command for execution of a test was given to the elevator control 15.1. A first test at the time point $t_T(1)$ is attributable to the method step S12. In this case it was successfully checked, shortly before a strong increase in use frequency in the morning, that the elevator is available.

A second test at the time point $t_T(2)$ is attributable to the method step S7. In this case it was checked shortly after a strong decrease in the use frequency below the minimum value $N_{min}(i,t)$ towards fifteen hours whether the elevator 1.1 is available. The result is negative: the use frequency $N_m(t)$ for $t>t_T(2)$ remains equal to "0" because the elevator 1.1 is unavailable.

The values for $N_S(i+1,t)$ for the use frequency and the minimum value $N_{min}(i+1,t)$ in the lower diagram of FIG. 3 are calculated from the values $N_S(i,t)$ and $N_m(i,t)$ for the time period ΔT(i) according to the iteration $N_S(i+1,t)=F(i,t,\lambda)$. For $t>t_T(2)+\Delta(i)$, $N_S(i+1,t)$ was set to be $=N_S(i,t-\Delta(i))$, since for this region no corresponding measured values of the use frequency in the time period ΔT(i) were registered ($N_m(t)=0$ for $t>t_T(2)$ in the time period ΔT(i), see above).

Obviously, for the estimated values $N_S(i+1,t)$ for the time period ΔT(i+1) the result is respective values which are greater than, the same as or smaller than the respective estimated values $N_S(i,t)$ for the time period ΔT(i) respectively depending on whether the measured values $N_m(i,t)$ are greater than, the same as or smaller than the corresponding estimated values $N_S(i,t)$ (presupposing $\lambda>0$).

The method "A" can be so organized that the test according to method step S8 is not executed at a predetermined time interval if, for example, the elevator 1.1 is not used or is used only little, for example during a night.

Method B

The method "B" is explained by way of an example for automatic checking of the availability of the elevator 1.1 with the help of the device 30.1.

The method B is based on the following measures:

1) on observation of the operation of the elevator 1.1 and in a given case on the registration of uses of the elevator 1.1 (so far as present) and a determination of the respective time point $t_B$ of a use with the help of the device 30.1,
2) on a determination of the time spacing of two successive uses, and
3) on an estimation of the time point up to which the next use is to be expected after the last registered use.

Measure 3) corresponds with estimation of a time spacing between the last registered use and the next use to be expected. The reciprocal value of this estimated time spacing corresponds with an estimated value for the use frequency for a time period which directly follows the last registered use.

In the case of performance of the method "B" the above measures 1)-3) are each carried out in respective succession and subsequently repeated. If up to the point in time estimated in measure 3) no further use of the elevator 1.1 is established then it can be supposed that the elevator 1.1 is unavailable. According to method "B" under this condition a command for execution of a test is given by the device 30.1 to the elevator control 15.1 and it is checked whether the elevator 1.1 shows a reaction corresponding with expectations.

Figure 5:
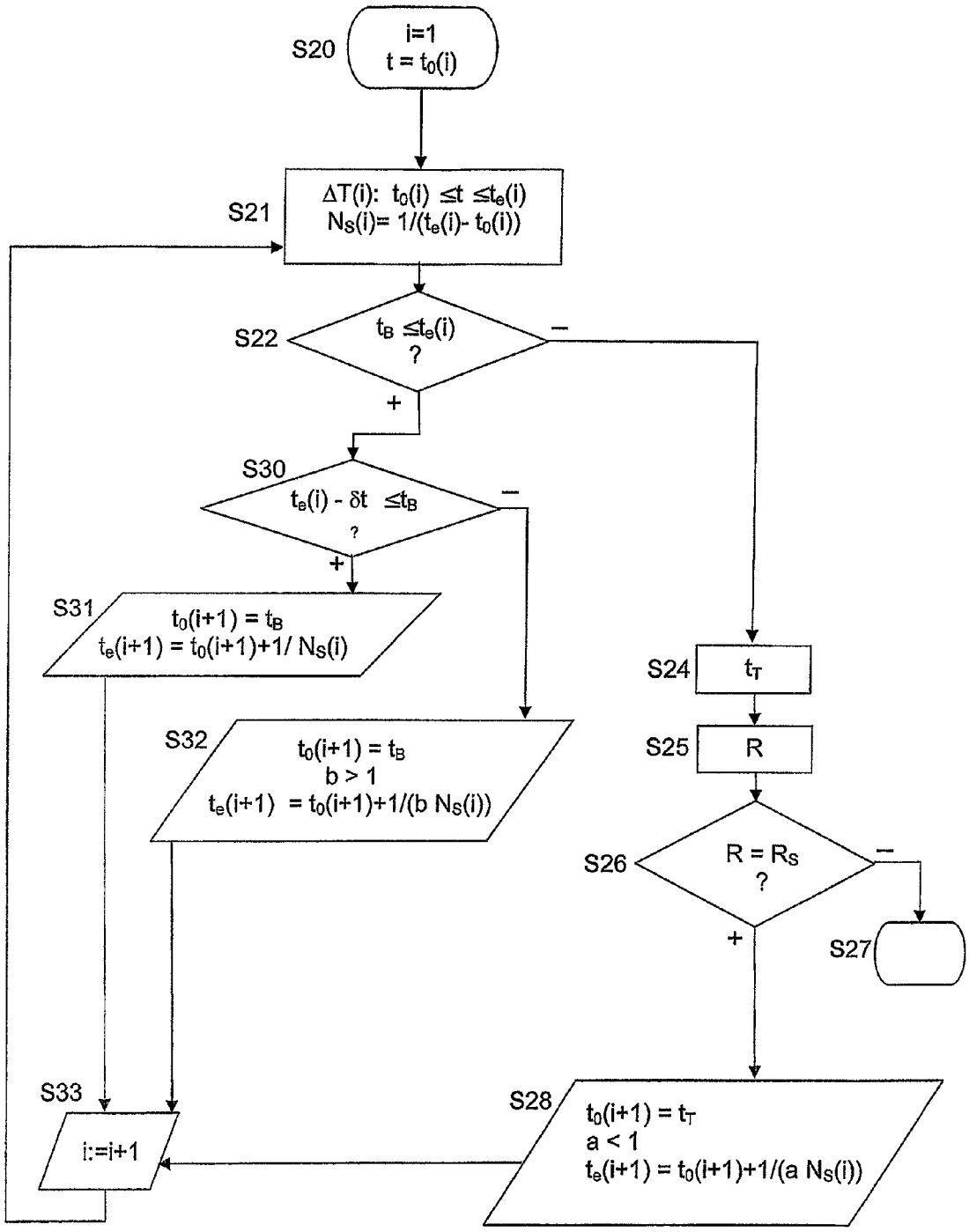
FIG. 5 is a flow chart for a further embodiment of the method according to the present invention.

FIG. 5 illustrates the steps of method "B" in the form of a flow chart with method steps S20-S33.

In method step S20 the device 30.1 is initialized: the processor P1 sets an internal counter "i" to i=1 and an internal clock to the time $t=t_0(i)$. The run-down of the program "P1.1" is started. Subsequently, there is continuation with method step S21.

In method step S21 a time period $\Delta T(i)$ with $t_0(i) \leqq t \leqq t_0(i)$ is established. The reciprocal value of the duration can be regarded as an estimated value $N_S(i)$ for the use frequency for the time period $\Delta T(i)$, i.e. $N_S(i)=1/[t_e(i)-t_0(i)]$. In the initialization of the method (i=1) according to method step S20 the time period $\Delta T(i)$ can be predetermined as desired, particularly since the device at the beginning of the method does not have available any data with respect to the uses of the elevator 1.1. The above magnitude $N_S(i)$ can accordingly show at the beginning of the method deviations of any size from the measured values for the use frequency.

In the following method step S22 it is checked whether in the time period $\Delta T(i)$ a use of the elevator takes place. If up to the end of this time period, i.e. prior to the time point $t_e(i)$, no use of the elevator takes place, there is continuation with method step S24. If a use takes place at the time point $t_e(i)$, then the time point $t_B$ of the use is registered and there is continuation with method step S30.

In method step S24 a command for execution of a test of the elevator 1.1 is given to the elevator control 15.1 (at the time point $t_T$). Subsequently there is continuation with method step S25.

In method step S25 a reaction "R" of the elevator 1.1 is registered.

Subsequently, in method step S26 the reaction "R" is compared with a target reaction "$R_S$". If the reaction "R" does not agree with the target reaction "$R_S$", it can be assumed that the elevator 1.1 is unavailable. In this case there can be continuation with method step S27 (path −). If the reaction "R" agrees with the target reaction "$R_S$", it can be assumed that the elevator 1.1 is available. In this case the starting point can be that the estimated value $N_S(i)$ defined in accordance with method step S21 is too large by comparison with the use frequency in actual operation. The method can accordingly be continued with method step S28 (path +).

In method step S27 it is communicated to the monitoring station 50 that the elevator 1.1 is unavailable. Subsequently, the method is interrupted. When the elevator 1.1 is available again, the method can be continued with the method step S20.

Method step S28: According to method step S26 there is a reason for the assumption that the estimated value $N_S(i)$ for the use frequency is too large by comparison with the use frequency of the elevator in actual operation. It is assumed that a realistic estimated value for the use frequency would be smaller by a factor a<1 than the above value $N_S(i)$. This assumption is checked in a following iteration step. Initially, the start and end of a time period, $\Delta T(i+1)$ with $t_0(i+1) \leqq t \leqq t_e(i+1)$, which follows the time period $\Delta T(i)$, is established. The start of the time period $\Delta T(i+1)$ is set to the time point $t_T$ of the test according to method step S24, and the end of the time period $\Delta T(i+1)$ is determined according to the assumption that a realistic value for the use frequency is given by the magnitude "a $N_S(i)$":

$$t_0(i+1)=t_T$$

$$t_e(i+1)=t_0(i+1)+1/[aN_S(i)]$$

The method is subsequently continued with method step S33.

In method step S30 it is checked whether the time point $t_B$ of the use lies in a time interval of the duration $\delta t$ at the end of the time period $\Delta T(i)$, i.e. it is checked whether the condition $t_e(i)-\delta t \leqq t_B \leqq t_e(i)$ is fulfilled. If yes, then the method is continued with method step S31 (path +). If no, then continuation is with method step S32 (path −). The duration $\delta t$ can be changed in dependence on the duration of the time period $\Delta T(i)$ in such a manner that, for example, $\delta t$ is always less than a specific fraction of the difference $t_e(i)-t_0(i)$. This leads in the course of the iteration to a dynamic adaptation of the method to changed conditions, for example if the use frequency of the elevator strongly varies in the course of time.

In method step S31 it is assumed that the estimated value $N_S(i)$, which is specified in method step S21, for the use frequency corresponds with the use frequency of the elevator in actual operation. This assumption is checked in the next iteration step. Initially the beginning and end of a time period $\Delta T(i+1)$ with $t_0(i+1) \leqq t \leqq t_e(i+1)$, which follows the time period $\Delta T(i)$, is established. The beginning of the time period $\Delta T(i+1)$ is set to the time point $t_B$ of the last registered use according to method step S22 and the end of the time period $\Delta T(i+1)$ is determined according to the assumption that a realistic value for the use frequency is given by the magnitude $N_S(i)$:

$$t_0(i+1)=t_B$$

$$t_e(i+1)=t_0(i+1)+1/N_S(i)$$

Subsequently the method can be continued with method step S33.

In method step S32 it is assumed that the estimated value $N_S(i)$ for the use frequency is too small by comparison with the use frequency of the elevator in actual operation. This assumption is checked in the next iteration step. Initially the beginning and end of a time period $\Delta T(i+1)$ with $t_0(i+1) \leqq t \leqq t_e(i+1)$, which follows the time period $\Delta T(i)$, is established. The beginning of the time period $\Delta T(i+1)$ is set to the time point $t_B$ of the last registered use according to method step S22 and the end of the time period $\Delta T(i+1)$ is determined according to the assumption that a realistic value for the use frequency is given by the magnitude "b $N_S(i)$", wherein b>1:

$$t_0(i+1)=t_B$$

$$t_e(i+1)=t_0(i+1)+1/[bN_S(i)]$$

Subsequently the method can be continued with method step S33.

In method step S33 the index i is increased by "1". Subsequently, the foregoing steps are repeated from method step S21.

In the case of suitable selection of the parameters $\delta t$, a and b the magnitude $N_S(i)$ converges, in the case of repeated use of the method steps S21 to S22, with a greater or lesser degree of rapidity towards the use frequency of the elevator in actual operation. Rapid changes of the use frequency as a function of time can be quickly recognized during run-down of the method steps S21-S32. A test according to method step S24 is caused only if an anticipated next use is absent for an unexpectedly long period of time (method step S22).

A further advantage of the method "B" is to be seen in the fact that the processor P1 only has to take into consideration a small amount of data in each iteration step: during an iteration step merely three different points in time have to be taken into consideration (beginning and end of the time period $\Delta T(i)$ according to method step S21 and the time point $t_B$ of the last use). Moreover—by contrast to method "A"—no statistical data for uses over long periods of time have to be detected and stored. Accordingly, for performance of the method "B" less storage space is required (this relates to the memories M12, M13, M22 and M23 of the device 30). Moreover, the processor requires less computing time. The method "B" can be organized so that the test according to method step S24 is not executed in a predetermined time interval if, for example, the elevator 1.1 is not used or is used only little, for example during a night.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for automatic checking of the availability of technical equipment in or at a building, wherein the technical equipment executes at least one repeatable procedure, comprising the steps of:

performing at least one test of the technical equipment in which test at least one reaction of the technical equipment is registered and compared with a target reaction, wherein in the case of availability of the technical equipment the reaction corresponds with the target reaction; and determining a measured value for the frequency of the performance of the procedure for a first time period is determined and the test is carried out when the measured value is smaller by a predetermined amount than a predetermined value which is set to be either equal to a first estimated value for the frequency of the performance of the procedure for the first time period or equal to a second estimated value for the frequency of the performance of the procedure for a second time period.

2. The method according to claim 1 wherein if the reaction does not correspond with the target reaction, a predetermined information is communicated to a monitoring station.

3. The method according to claim 1 wherein each reaction and/or each procedure is registered by registration of a change of a state of at least one of a drive, a current supply, a sensor, a light source of the technical equipment and registration of signals for control of the technical equipment.

4. The method according to claim 1 wherein a duration of a time interval is predetermined and a number of performances of the procedure, which are registered during the time interval, is determined and the measured value is calculated from the number and the duration.

5. The method according to claim 1 wherein a number of performances of the procedure is predetermined and a duration of a time interval in which these performances are registered is determined and the measured value is calculated from the number and the duration.

6. The method according to claim 1 wherein the first estimated value and the measured value for the first time period are determined and the second estimated value for the second time period is set to a first value which (i) is equal to the first estimated value if the first estimated value and the measured value differ by more than a predetermined amount or (ii) is smaller than the first estimated value if the measured value is smaller than the first estimated value by more than the predetermined amount or (iii) is greater than the first estimated value if the measured value is greater than the first estimated value by more than the predetermined amount.

7. A device for automatic checking of the availability of technical equipment in or at a building, which technical equipment includes a control and executes at least one repeatable procedure, which device comprises:

a command transmitter by which a predetermined command for execution of at least one test of the technical equipment can be given to the control, wherein the test is so selected that in the case of availability of the technical equipment a target reaction of the equipment can be registered;

a registration device for registration of a reaction which follows the command of the technical equipment; and a device for comparison of the reaction with the target reaction including:

equipment for determining and/or storing a first estimated value for the frequency of the performance of the procedure for a first time period and/or for determination and/or storage of a second estimated value for the frequency of the performance of the procedure for a second time period;

a measuring device determining a measured value for the frequency of the performance of the procedure for the first time period; and a control device for controlling the command transmitter in such a manner that the command is given when the measured value is smaller by a predetermined amount than one of the estimated values.

8. The device according to claim 7 wherein said registration device and/or said measuring device comprises: equipment for registering a change a state of at least one of a drive, a current supply, a sensor, a light source, the technical equipment, and equipment for registering signals for control of the technical equipment.

9. The device according to claim 7 wherein a communications connection is present for communication of predetermined information to a monitoring station for the case that the reaction does not correspond with the target reaction.

10. A method for automatic checking of the availability of elevator equipment in a building, wherein the elevator equipment executes at least one repeatable procedure, comprising the steps of:

performing at least one test of the elevator equipment in which test at least one reaction of the elevator equipment is registered and compared with a target reaction, wherein in the case of availability of the elevator equipment the reaction corresponds with the target reaction; and determining a measured value for the frequency of the performance of the procedure for a first time period is determined and the test is carded out when the measured value is smaller by a predetermined amount than a predetermined value which is set to be either equal to a first estimated value for the frequency of the performance of the procedure for the first time period or equal to a second estimated value for the frequency of the performance of the procedure for a second time period.

11. The method according to claim 10 wherein each reaction and/or each procedure is registered by registration of a change of a state of at least one of an elevator drive, a drive current supply, a sensor, a light source of the elevator equipment and registration of signals for control of the elevator equipment.

* * * * *